US005667393A

United States Patent [19]

Grabbe et al.

[11] Patent Number: 5,667,393

[45] Date of Patent: Sep. 16, 1997

[54] PRINTED CIRCUIT BOARD ELECTRICAL CONNECTOR WITH SEALED HOUSING CAVITY

[76] Inventors: Dimitry Grabbe, 2160 Rosedale Ave., Middletown, Pa. 17057; Iosif Korsunsky, 4980 Farmington Rd., Harrisburg, Pa. 17112

[21] Appl. No.: 502,654

[22] Filed: Jul. 14, 1995

[51] Int. Cl.[6] ..... H01R 9/09

[52] U.S. Cl. ..... 439/83; 439/660

[58] Field of Search ..... 439/78–83, 85, 439/444, 660, 869, 874, 876

[56] References Cited

U.S. PATENT DOCUMENTS

| | | | |
|---|---|---|---|
| 4,501,465 | 2/1985 | Hoshino et al. . | |
| 4,637,670 | 1/1987 | Coller et al. . | |
| 4,682,829 | 7/1987 | Kunkle et al. | 439/83 |
| 4,718,855 | 1/1988 | Billman et al. | 439/70 |
| 4,978,308 | 12/1990 | Kaufman | 439/83 |
| 5,015,192 | 5/1991 | Welsh et al. | 439/83 |
| 5,037,316 | 8/1991 | Fukushima et al. | 439/79 X |
| 5,137,454 | 8/1992 | Baechtle | 439/62 |
| 5,306,163 | 4/1994 | Asakawa | 439/74 |
| 5,439,385 | 8/1995 | Sakai et al. | 439/83 X |
| 5,476,389 | 12/1995 | Ono | 439/83 |

*Primary Examiner*—Khiem Nguyen

[57] ABSTRACT

An electrical connector assembly 2 for use in connecting parallel printed circuit boards includes a receptacle connector 4 and a plug connector 6. The receptacle connector 4 includes receptacle contacts 8, each of which includes a surface mount solder tail 16 and a mating contact section in the form of a resilient arm 26 on opposite sides of a sealing pad 18 that seals a contact insertion opening 38 when the receptacle contact 8 is fully inserted. The mating contact portion is therefore isolated from contaminating materials, such as solder flux during surface mount solder operations. The height of the connector assembly 2 can be adjusted by using plug connectors 6 of different heights with a universal receptacle connector 4. The height of the side walls 60 on the plug housing 12, between a plug mating section and contact retention section is changed for different plug connector heights. The length of the plug contact 10 can also changed because the plug contact solder tail 56 is bent into its final position after the plug contacts 10 are mounted on the plug housing 12.

34 Claims, 7 Drawing Sheets

PRINTED CIRCUIT BOARD ELECTRICAL CONNECTOR WITH SEALED HOUSING CAVITY

BACKGROUND OF THE INVENTION

1. Field of the Invention

This invention is related to soldering electrical components, such as electrical connectors, to substrates, such as printed circuit boards. More particularly, this invention is related to soldering subminiature multiposition electrical connectors to printed circuit boards using surface mount processes, such as laser reflow, hot oil and other surface mount techniques. This invention is specifically related to eliminating contamination of contact surfaces of electrical connectors during soldering operations, including fluxing and flux removal and cleaning operations in general. This invention is also related to subminiature electrical connectors of this type in which connectors of substantially the same design can be used to interconnect printed circuit boards that must be spaced apart by different distances.

2. Description of the Prior Art

The two typical methods of soldering electrical or electronic components, such as electrical connectors, to printed circuit boards are through hole soldering and surface mount soldering. Surface mount soldering offers certain advantages over through hole soldering, primarily the ability to achieve higher component density and therefore smaller overall printed circuit board assembly size. Therefore surface mount soldering is the preferred technique for applying large numbers of components to printed circuit boards having a relatively small available circuit board surface area. Devices such as laptop or notebook or pocket computers, personal digital assistants, portable computer accessories, and cellular telecommunications devices are typical examples of applications in which a large number of components must be soldered to relatively small printed circuit boards.

Electrical connectors for connecting traces on one printed circuit board to another printed circuit board represent one of the relatively larger components employed in such applications. Many electrical connectors are of the through hole type and their use with surface mount applications can either require an additional soldering operation, sometimes even a hand soldering operation, or can restrict the soldering processes to those applicable to hybrid surface mount and through hole boards. Surface mount electrical connectors are, however, available for use on printed circuit boards that use only surface mount devices. It is important that these connectors be as small as possible, both so that the total surface area and volume of the printed circuit board assemblies and subassemblies can be as small as possible and to minimize the length of circuit paths in high speed applications.

Surface mount electrical connectors typically employ a number of electrical contacts mounted in an insulative connector housing. In applications where two printed circuit boards are to the connectable and disconnectable, for example for attaching additional memory and the like, these connectors comprise mating plug and receptacle connector members. Mating terminals or contacts in the receptacle and plug connectors must have mating or contact surfaces for establishing and maintaining electrical continuity with the mating terminal or contact. Typically this contact is maintained by resilient engagement of the mating contacts.

Each of these mating terminals must also include a surface mount solder lead positioned on an exterior surface of the connector housing. Although there are several standard surface mount lead configurations, including gull wing, J-leads and I-leads or butt leads, the conventional surface mount lead used for surface mount electrical connectors includes a section soldered to a surface mount pad on a printed circuit board with this solder section extending parallel to the printed circuit board and substantially at a right angle relative to the terminal or contact. These solder lead sections should also be visible for inspection and therefore clearance is normally provided along the lower edge of the connector housing. These terminals are inserted into cavities in a connector housing from the top or from the bottom with the solder lead section extending parallel to the base of the connector housing. The opening in the housing base through which the contact is inserted must either provide clearance for the contact portion of the terminal or the parallel lead section. For conventional connectors this opening exposes the contact portion of the terminal to the solder process. One common problem encountered with these conventional connectors occurs when solder flux from the circuit board enters the housing cavities and forms a flux film on the mating portion of the terminals. These flux films, may not be completely removed during the washing or cleaning process. Even where "no wash" solder flux is used, there may still be some contamination due to flux residues on the mating contact portions of terminals. These flux residues contaminate the contacts and adversely affect the performance and reliability of the connectors. Even where solder flux and other fluids can be controlled during normal surface mount processes, these problems can also arise during repair of defective solder joints where it is not possible to control the application of solder flux and other fluids to the same extent as during the initial soldering process.

One prior art approach to this problem is to seal the bottom of the connector after the contacts have been inserted. Some have suggested that plugs be inserted into the cavity openings. However, the most common means of flux blockage that has been attempted in the industry is the use of a sealant dispensed into or onto the connector after connector assembly to seal the cavity openings. Application of a sealant after the connector has been assembled is a cumbersome, expensive and undesirable process.

Of course problems with solder, solder flux, contaminants and lead placement are also affected by the need to make the connector package as small as possible. Even though circuit board real estate is generally at a premium, different connectors are needed for different applications in which the spacing of parallel boards is different. In other words different connector heights are needed. For example, one commercially available parallel board to board plug/receptacle connector assembly is available in twelve different heights ranging from 5 mm (0.197 in) to 16 mm (0.630 in). Four plug connectors and three receptacle connectors are required to provide twelve different mating connector assemblies ranging from 5–16 mm in increments of one min. There are applications for connectors with heights ranging from 4 mm (0.158 in) to 25 mm (0.985 in). Furthermore different applications will require connectors with different numbers of positions. For example, the commercially available connector assembly just mentioned is available from forty to two hundred positions, in increments of twenty positions. Since applications for connectors of this type are always changing, the useful life, from conception to obsolescence, of a specific connector with a given height and number of positions, may be quite short. The short life of these connectors places additional constraints on their design due to tooling and other costs. There is a need for relatively simple designs with designed-in flexibility for production of basically similar connectors with different heights and different numbers of positions in order to reduce the cost of each connector. If the connector cost can be reduced and if processes such as washing the printed circuit board assembly after soldering can be eliminated, the installed cost of the connector can be reduced and the cost of the entire product can be reduced.

SUMMARY OF THE INVENTION

These and other problems inherent in the prior art are addressed by a family of electrical connector assemblies suitable for interconnecting printed circuit boards in which a universal receptacle connector with a sealing contact is used with similar plug connectors that differ only in height. This connector family combines flexibility of manufacture with economical manufacture of connectors having varying numbers of contact positions.

The problems due to solder flux contamination are addressed by incorporating a sealing pad on a receptacle plug contact. The receptacle contact has a mating portion and a solder tail on opposite sides of the sealing pad. Each receptacle contact is inserted through an opening on the bottom of the receptacle connector housing. The receptacle contacts are then moved laterally and the sealing pad closes off the contact insertion opening. In the preferred embodiment of this invention, the sealing pad comprises a flat section that is inserted into a channel located at the bottom of the housing cavity containing the contact mating portion. The sealing pad forms an interference fit in the channel and engages the housing around the periphery of the insertion opening.

The flat section of the terminal used to seal the contact insertion opening in the preferred embodiment can also be used to anchor the contact terminal in the housing. This flat contact section can be anchored in the laterally extending channel even in applications where it is not necessary to seal the contact opening. The contact terminal can be anchored in this way for surface mount contacts and for through hole contacts and for applications in which parallel or non parallel printed circuit boards are to be interconnected.

In the preferred embodiment, the mating receptacle contact can employ a resilient arm that can be deflected upon engagement with a mating plug contact. The resilient arm is deflectable about the anchoring engagement between the flat section of the contact terminal and the housing channels. By using this anchoring approach, substantially the entire height of the contact terminal above the flat section is deflectable. This increases the deflection of the contact point and this increased potential displacement eliminates many component mismatch problems due to placement of components on separate printed circuit boards. This increased available deflection is especially useful in applications where multiple connectors on the same interconnected circuit boards are employed. In the preferred embodiment of this invention, the mating portion of the contact consists o of a section adjacent to the anchoring section and extending along the floor of the housing cavity. A bowed section joins this initial section with the upwardly extending resilient arm and a contact point or cusp is located near the top of the resilient arm.

The laterally extending mounting or anchoring of this contact can be used with contacts in which the solder lead or tail section is preformed or where the solder tail is formed after contact insertion. For preformed surface mount solder tails the lateral insertion of the contacts simplifies assembly. Where the solder tails are formed after contact insertion, the lateral insertion of the contact positions the solder tail section along an unobstructed side of the connector housing where forming tooling can be used to fabricate gull wing leads. Coplanarity of the solder pad sections of the gull wing leads can then be maintained even in applications where the housing may be bowed or warped.

A copending application entitled Adjustable Height Sealed Electrical Connector (Attorney's Docket Number 16069) filed on the same date as this application is directed to a family of printed circuit board connectors of different heights as described in this application.

DETAILED DESCRIPTION OF THE PREFERRED EMBODIMENTS

Figure 1:
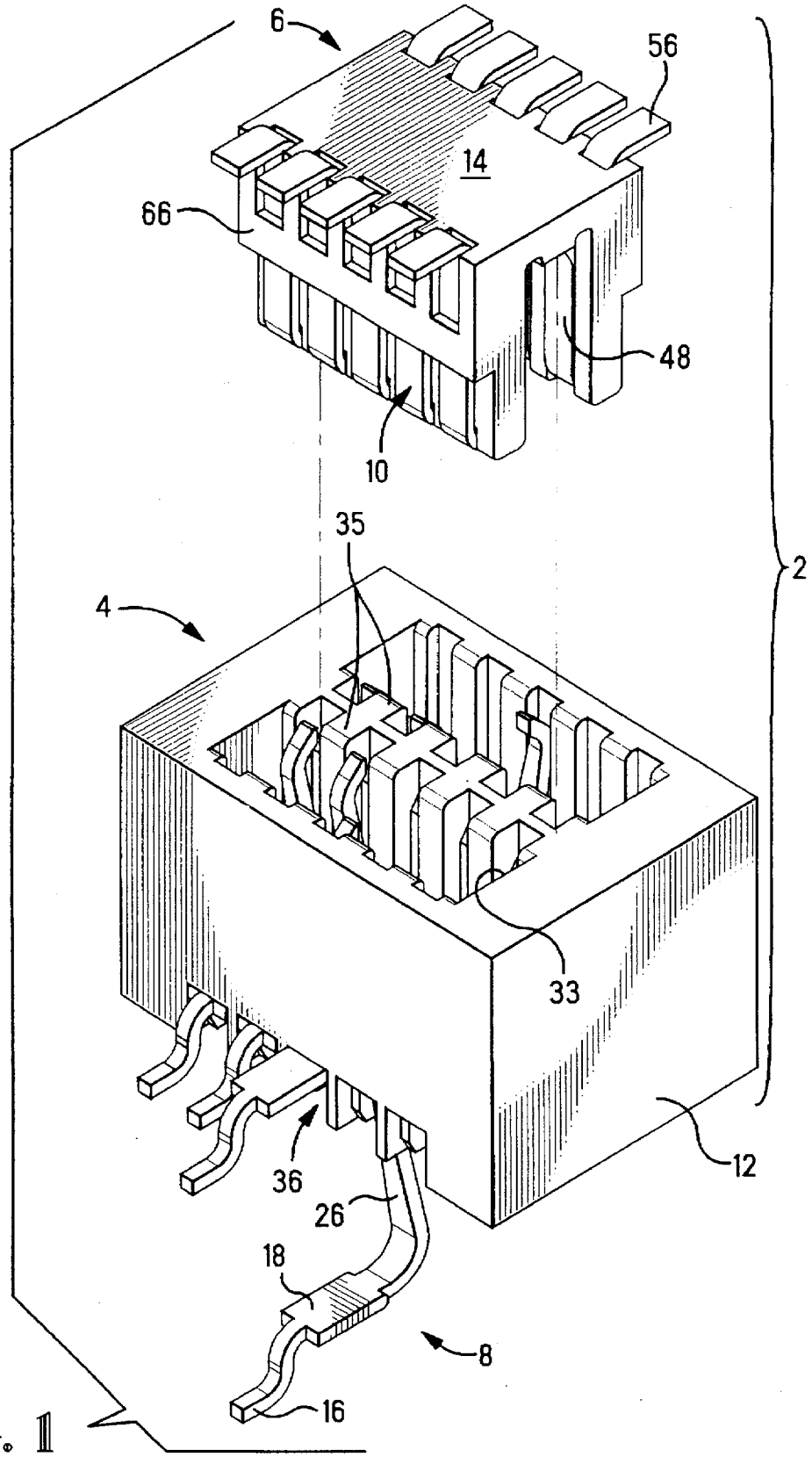
FIG. 1 is a perspective view of a multiposition electrical connector for connecting two parallel printed circuit boards. These plug and receptacle connectors exhibit the preferred embodiment of this invention.

The surface mount multiple position electrical connector assembly 2 shown in FIG. 1 is representative of a parallel board connector assembly embodying this invention. The connector assembly 2 includes a receptacle connector 4 that mates with a corresponding plug connector 6. One of these two connector halves would be soldered to one printed circuit board and the other would be soldered to a second printed circuit board. Using this embodiment of the connector assembly 2, two printed circuit boards can then be connected parallel to each other by mating the receptacle connector 4 to the plug connector 6. Both the receptacle and plug connectors shown in FIG. 1 are ten position connectors with two rows of five contacts. It should be understood that these connectors are only representative of connectors having a larger or smaller number of positions.

The preferred surface mount receptacle connector 4 has two rows of receptacle contacts or terminals 8 mounted in a receptacle housing 12. The plug connector 6 also includes two rows of plug contacts or terminals 10 mounted in a plug housing 14. Corresponding receptacle terminals 8 and plug terminals 10 engage each other to form a mating interface when the two connectors 4 and 6 are mated. Similarly the receptacle housing 12 is configured to mate with the plug housing 14. The receptacle contacts 8 and the plug contacts 10 can each be stamped and formed using a conventional resilient electrically conductive material, such as a copper alloy. Each terminal can be plated with a tin lead plating on the solder contact sections and with a noble metal plating, such as gold, on the mating interface in accordance with the prior art practice in the electrical connector industry. The receptacle housing 12 and the plug housing 14 can each be fabricated from a conventional insulative material such as liquid crystal polymer, that can withstand the temperatures encountered during conventional surface mount soldering processes.

Figure 2:
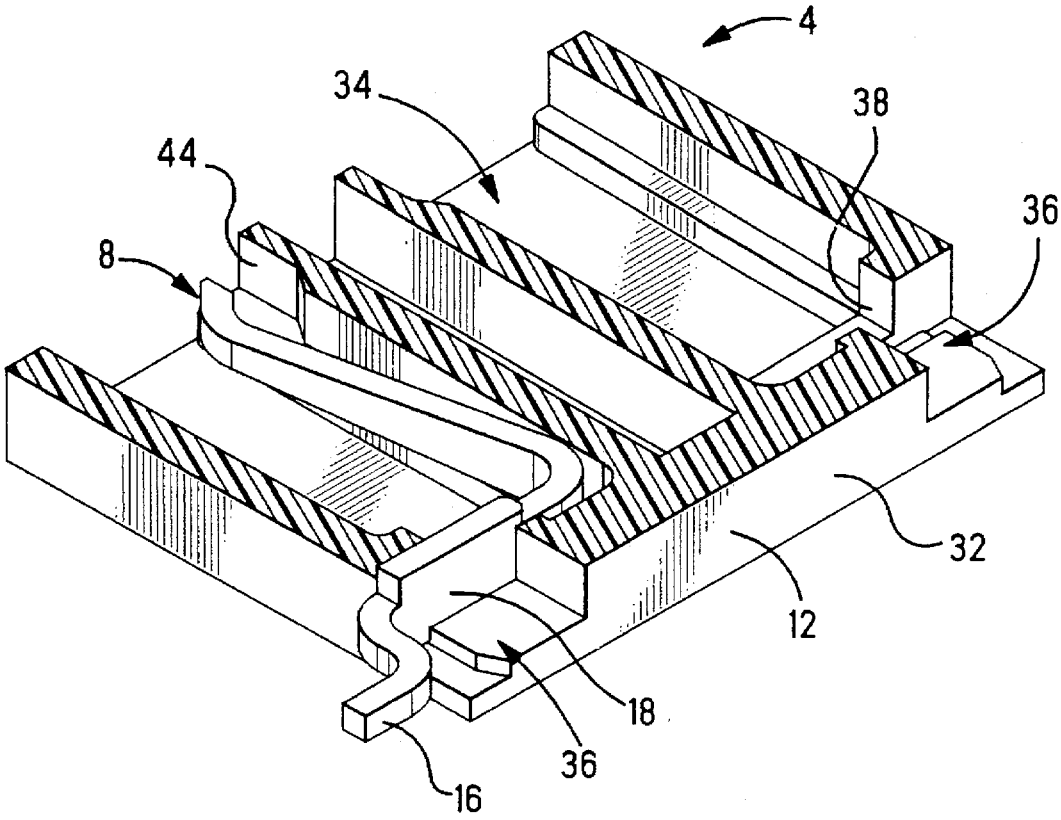
FIG. 2 is a perspective view showing a section taken along section lines 2—2 in FIG. 1 showing the receptacle connector housing in section and showing the position of a receptacle contact in one cavity in the housing.

Each receptacle contact or terminal 8 is mounted in a receptacle housing cavity 34 in the receptacle housing 12 as shown in FIG. 2. The receptacle contacts 8 comprise one piece stamped and formed members of relatively short overall length and suitable for transmission of relatively high speed electrical signals. A receptacle contact surface mount leg or tail 16 is located at one end of each receptacle contact 8 and is integral with a resilient receptacle contact arm 26. A receptacle contact mating surface or cusp 28 is located adjacent the top end of each resilient section 26 of the receptacle contacts 8. As shown in FIG. 2, the resilient contact arm 26 is located in the housing cavity 34 and the solder tail or leg 16 projects outwardly from the housing 12 along the housing base and is exposed along one side. This solder tail configuration is generally referred to as a gull wing solder tail having a pad that extends parallel to the base of the connector housing. It should be understood that this pad section may not extend precisely parallel. For example, the pad section could extend at a small angle, for example five degrees, in which case the solder pad contact could be slightly deflected when it engages a solder pad on the printed circuit board to which it is mounted. The solder tail 16 is therefore in position to be soldered to a surface mount pad on a corresponding printed circuit board, and the resilient arm 26 is positioned to engage a mating plug contact 10 is inserted into the housing cavity 34.

Figure 3:
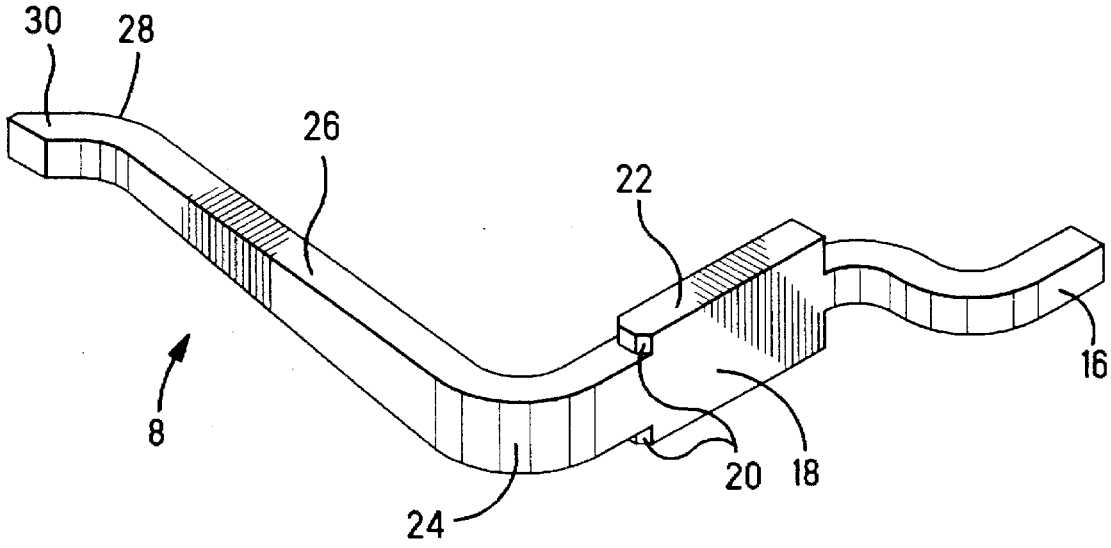
FIG. 3 is a perspective view of one of the receptacle contacts.

As shown in FIGS. 2 and 3, each receptacle contact 8 includes a relatively flat section 18 or sealing pad between the solder tail 16 and the resilient contact arm 26. This sealing pad 18 prevents the entry of fluids, such as solder flux, into the corresponding housing cavity 34 to prevent contamination of the contact mating interface at the cusp 28. The section seating pad 18 also functions as a contact anchoring section to anchor each contact in the housing as will be discussed in more detail subsequently. This sealing pad 18 seals any opening on the bottom of the housing cavity 34 when positioned as shown in FIG. 2. The manner in which this sealing pad 18 is positioned to close off an insertion opening 38 communicating with the bottom of the cavity 34 will be subsequently discussed with reference to insertion of the receptacle contacts 8 into the receptacle housing 12.

In this embodiment the sealing pad 18 is wider than those portions of the terminal on each end thereof, and the sealing pad 18 has a beveled or chamfered or radiused surface 20 on the front edge on opposite sides of the portion of the contact 8 that extends into the housing 12. Oppositely facing side edges 22 of the sealing pad 18 are therefore wider than adjacent terminal portions. In this preferred embodiment, the thickness of each terminal is constant. In other embodiments, the mating portion or the solder tail can be thinner than the sealing pad 18, and the solder tail can be as wide as the sealing pad 18. In this embodiment, the solder tail 16 is formed downwardly from the sealing pad 18 and is substantially parallel to the sealing pad and spaced below it. The surface mount tail 16 is also narrower than the sealing pad 18. A bowed section 24 is formed between the sealing pad 18 and the resilient contact arm 26. This bowed section 24 is curved so that the resilient arm 26 in its unflexed condition, extends at an acute angle relative to the sealing pad 18, such that it will extend at an angle relative to an adjacent wall when inserted into the corresponding housing cavity 34. The curved contact cusp 28 or mating interface point forms the innermost portion of the resilient arm 26 and is spaced further from the adjacent cavity wall where it can engage a mating plug contact when mated. An outwardly formed or curved receptacle contact entry section 30 is formed at the upper end of the contact 8 to form a smooth contour so that the contacts will not stub during mating. The end of this curved contact entry section is also positioned to engage, when flexed, an adjacent cavity wall section 44 that serves as a stop to prevent the contact from being overstressed. Dividing ribs 35 extend from the inner housing wall to separate adjacent receptacle contacts 8.

Figure 4:
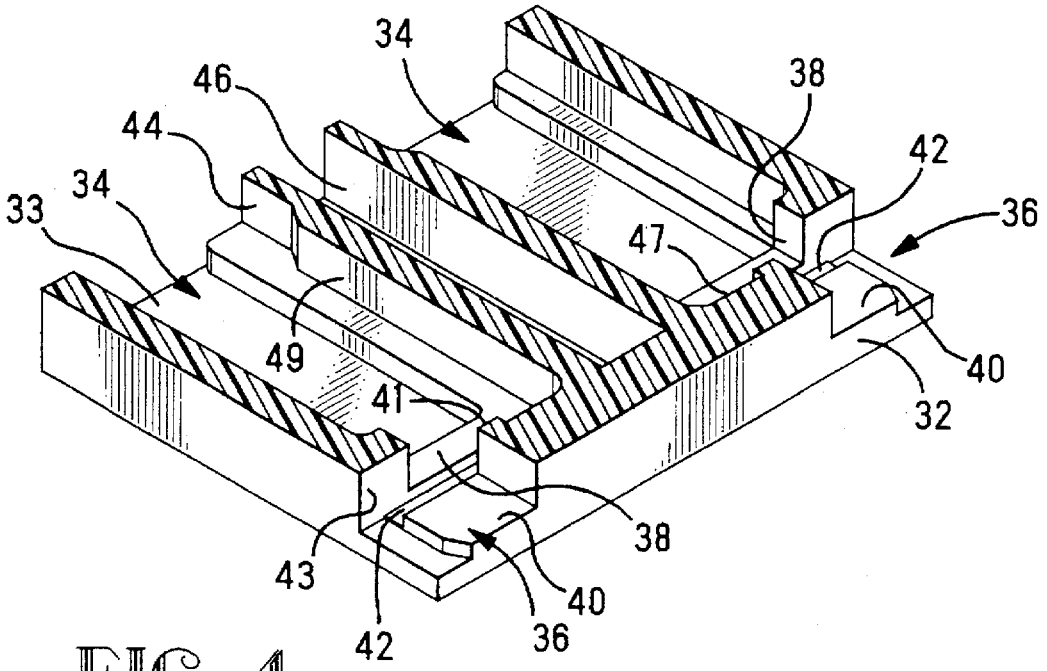
FIG. 4 is a perspective view showing opposed cavities of the receptacle connector housing.
Figure 11:
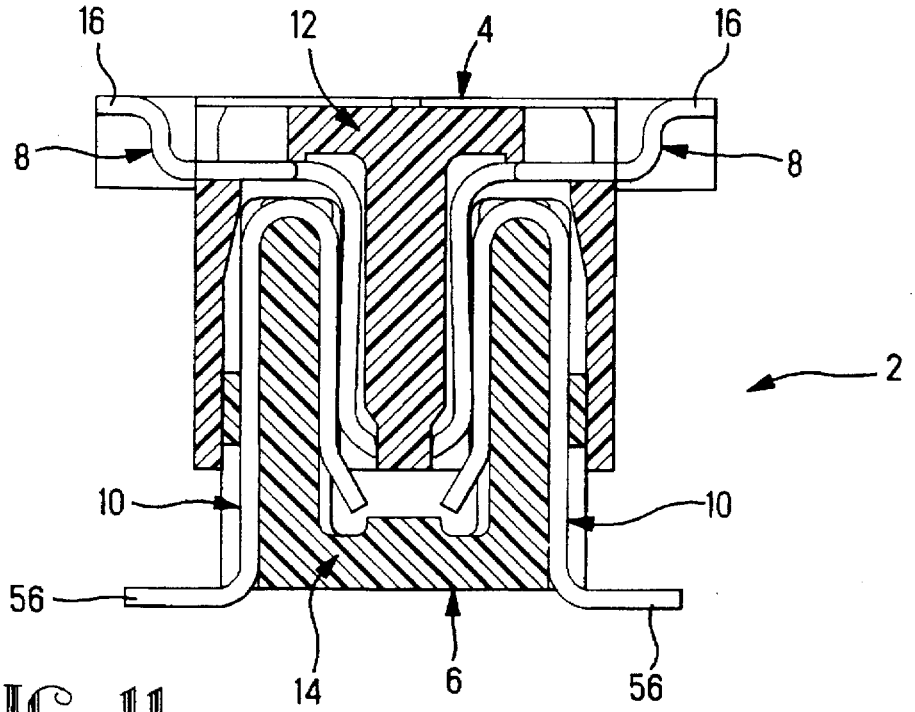
FIG. 11 is a sectional view of a mated plug and receptacle connector.

The receptacle housing 12 has two rows of side by side housing cavities 34 in which individual receptacle contacts 8 are located. Each cavity 34 is open at the top. As shown in FIGS. 1 and 4, a slot 33 extends through all of the cavities in each row of cavities in the multiposition receptacle connector 4. A contact insertion opening 38 extends from each cavity 34 through the housing base 32 to a corresponding receptacle housing surface mount pocket 36. Each of these pockets 36 is open on the side of the housing so that a surface mount solder tail 16 positioned in as pocket 36 is exposed. As shown in FIG. 4 each pocket 36 has a ledge 40 on each side of the pocket. A sealing channel 42 is located at the top of each pocket 36 on each side of the pocket 36 adjacent to the insertion opening 38. The tops of ledges 40 form the lower surface of the channels 42. Each sealing channel 42 extends inwardly beyond the pocket 36 and a shoulder 41 on the bottom of the cavity 34 is on the same level as the upper surfaces of the adjoining ledges 40. A downwardly facing surface 43 at the outer side of each pocket 36 is located at the top of each channel 42 and an extension 45 of this surface faces the top surface of the corresponding ledge 40 to form the top of the channel 42. Each channel 42 is deep enough to receive sealing pad 18 and to form an interference fit with the edges of the sealing pad. The top of ledges 40, the surface 41 and the surfaces 43 and 45 thus engage the entire periphery of sealing pad 18 to close off and seal opening 38. In addition to sealing the contact insertion opening 38, the channel 42 functions as a contact anchoring channel since the sealing pad 18 is inserted into the channel and serves to anchor the receptacle contact 8 in the housing 12. The cavities 34 extend inwardly beyond the corresponding solder tail pocket 36 and the lower surface 47 and inner wall 49 of the cavity 34 provide sufficient clearance for the resilient arm 26 of the receptacle contact 8. Ribs 35 extending between the lower cavity surface 47 and the top of the connector, separate adjacent contact arms 26. A recess 44 at the top of the inner cavity wall 49 provides clearance for the entry section 30 of the contact and provides an overstress stop so that the contact entry section 30 engages the inner surface of recess 44 before the contact 8 can be overstressed and damaged. Two slightly different versions of the receptacle housing 12 are depicted herein. The version of the receptacle housing 12 shown in FIGS. 2 and 4–7 include a central core or slot section 46 between two cavities 34 on opposite sides of the housing. The embodiments of FIGS. 1 and 11 have no such central slot. The receptacle connector 4 of FIGS. 1 and 11 are therefore narrower than the embodiments including as central core section 46.

By inserting the receptacle contacts 8 laterally into the housing 12, substantially the entire length of the receptacle contact within the housing is a deflectable resilient member. The bowed section 24 of contact 8 is located along the cavity floor 47 and the resilient arm 26 extends upwardly from this floor. Thus the deflection of the contact when mated extends upwardly from the floor to the contact point 28. This results in better utilization of the vertical height of the housing and the cavity 34 than with conventional configurations in which a vertical section of the contact is used to retain the contact in the housing. Greater total deflection of the contact point 28, for a given overall connector height, helps overcome mating alignment and tolerance problems that can be especially problematical where more than one separate connector is used to interconnect two printed circuit boards. The innerengagement of flat contact section 18 with the channel 42 thus serves to anchor the receptacle contact 8 in the housing 12 and the resilient contact arm deflects about this laterally extending anchoring section. The flat plate-channel engagement represented here thus can be used even in applications where sealing is unnecessary and the relative dimensions of the flat section 18 and the channel 42 can be chosen for those applications without regard to sealing. Although the laterally extending flat section 18 and the channel 42 are shown extending parallel to the housing base, it should be understood that these sections could extend laterally at another angle.

Figure 5:
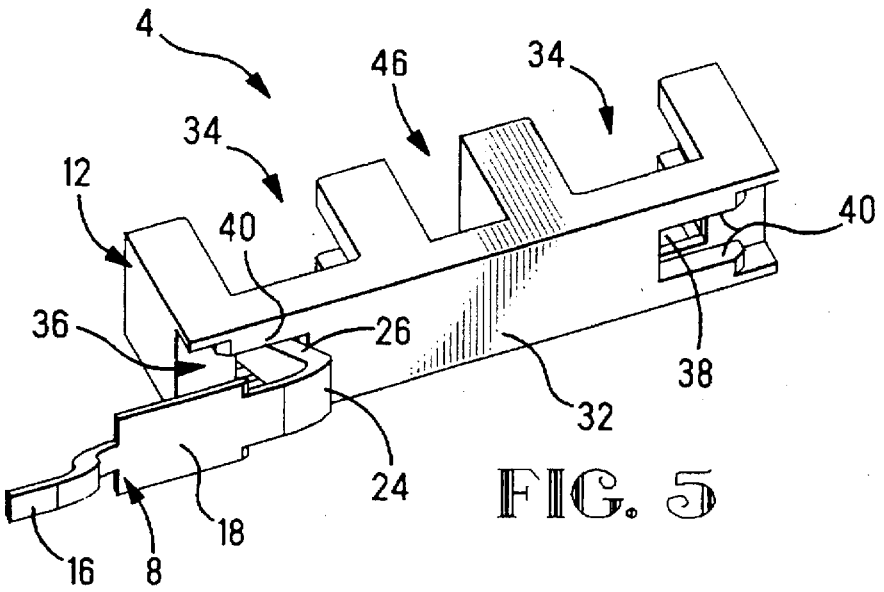
FIGS. 5, 6 and 7 are perspective views showing three positions during insertion of a receptacle contact into the receptacle housing.
Figure 6:
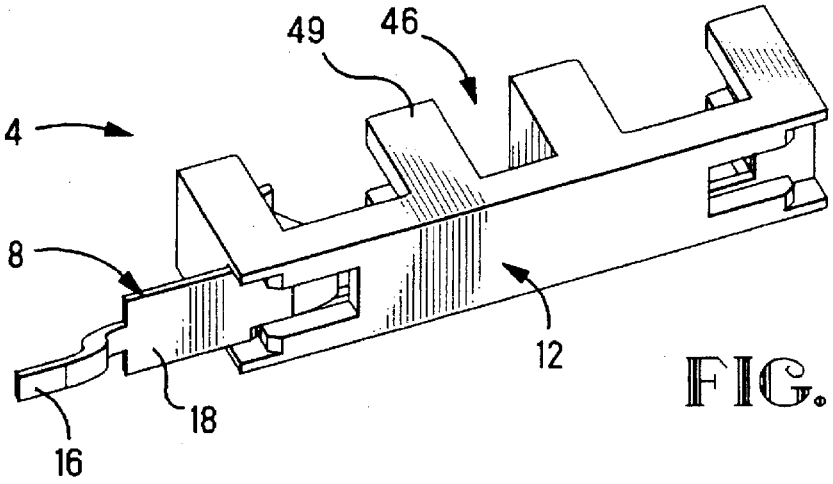
Figure 7:
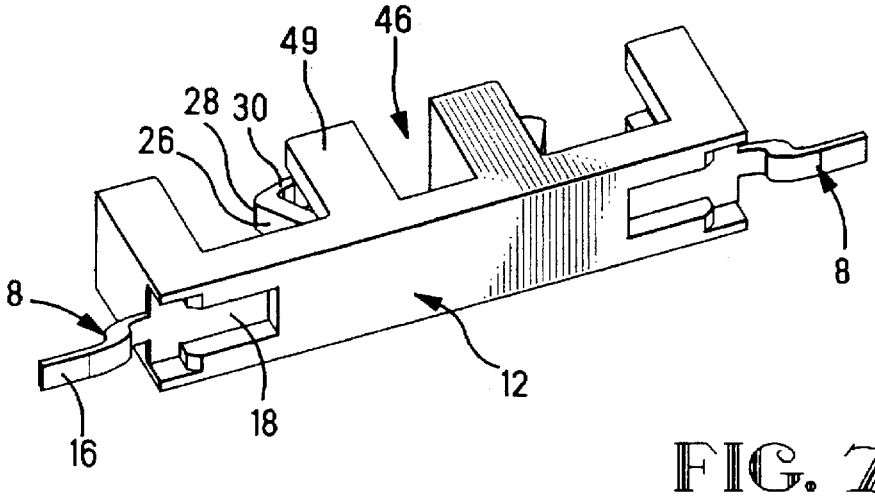
Figure 8:
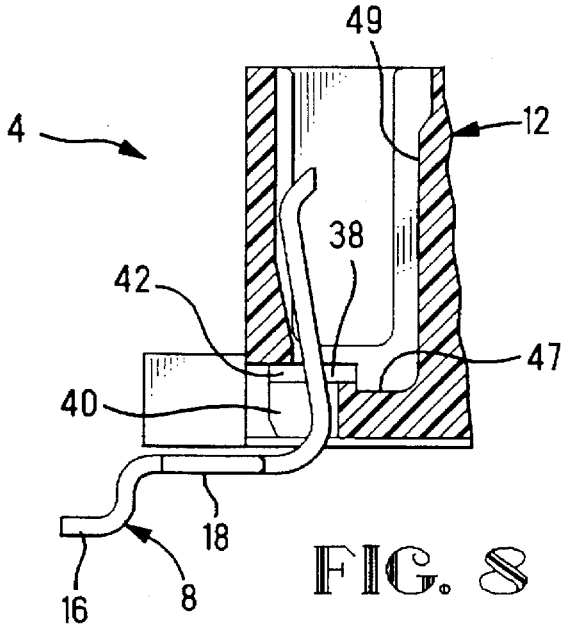
FIGS. 8, 9 and 10 are section views corresponding to FIGS. 5, 6 and 7 respectively.
Figure 9:
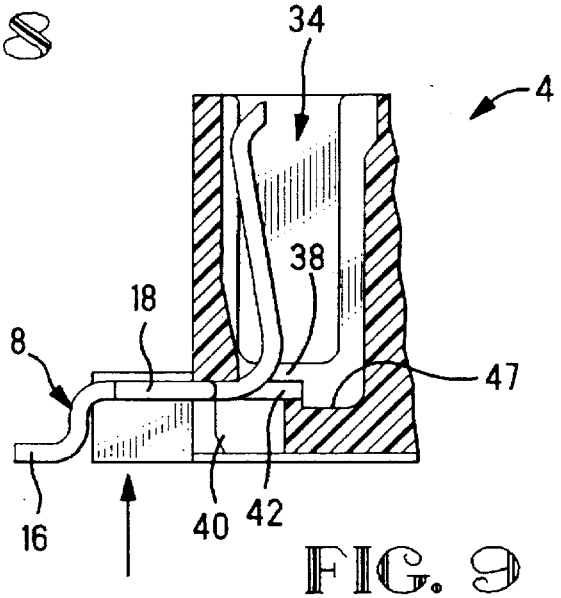
Figure 10:
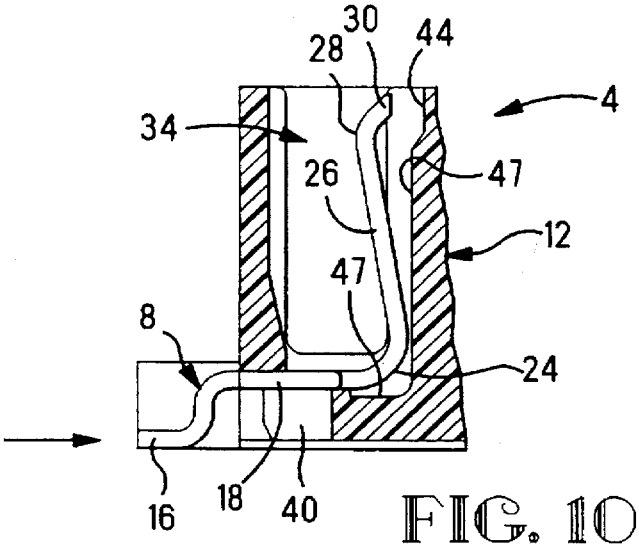

FIGS. 5–7 show the manner in which the receptacle contacts 8 are inserted into and positioned in the housing cavities 34. FIGS. 8–10 are section views corresponding respectively to FIGS. 5–7. These figures show three successive insertion positions. FIGS. 5 and 8 show the first insertion step in which the receptacle contacts 8 are inserted into the receptacle housing 12 from the bottom. The opening 38 is big enough for insertion of the resilient contact arm 26, and the remaining portions of the contact that are to be positioned within the contact cavity 34. When the contact arm 26 is inserted through opening 38, it will be positioned adjacent to the outside wall of the cavity 34 instead of its final position.

Each contact 8 is inserted into the cavity 34 through opening 38 until it reaches the position shown in FIGS. 6 and 9. In this second insertion position the sealing pad 18 will be positioned in the wider portion of the pocket 36 on the outside of the channel 42. The sealing pad 18 will engage the downwardly facing surface 43 and will then be aligned with the channel 42. The receptacle contacts 8 can now be laterally pushed into the final insertion position shown in FIGS. 7 and 10. Since the sealing pad 18 is wider than the solder tail 16, two shoulders are formed on sealing pad 18 on opposite sides of the solder tail 16. A simple insertion tool can then engage these two shoulders and the sealing pad 18 can be pushed into the channel 42 so that the resilient contact arm 26 can be moved to its final operative position in cavity 34. The chamfered surfaces 20 on the front of the sealing pad help align the sealing pad 18 with the channel 18 for insertion. In the final position shown in FIGS. 7 and 10, housing surfaces engage the complete periphery of the sealing pad 18 to seal the opening 38 and to isolate the mating contact surfaces within cavity 34 from the lower surface of the housing 12 and from the printed circuit board and from all of the steps of the surface mount solder process. The mating contact surfaces cannot be contaminated by solder, solder flux or any other chemicals or steps of a conventional soldering process or associated with conventional processes employed in mounting surface mount components on a printed circuit board.

Figure 12:
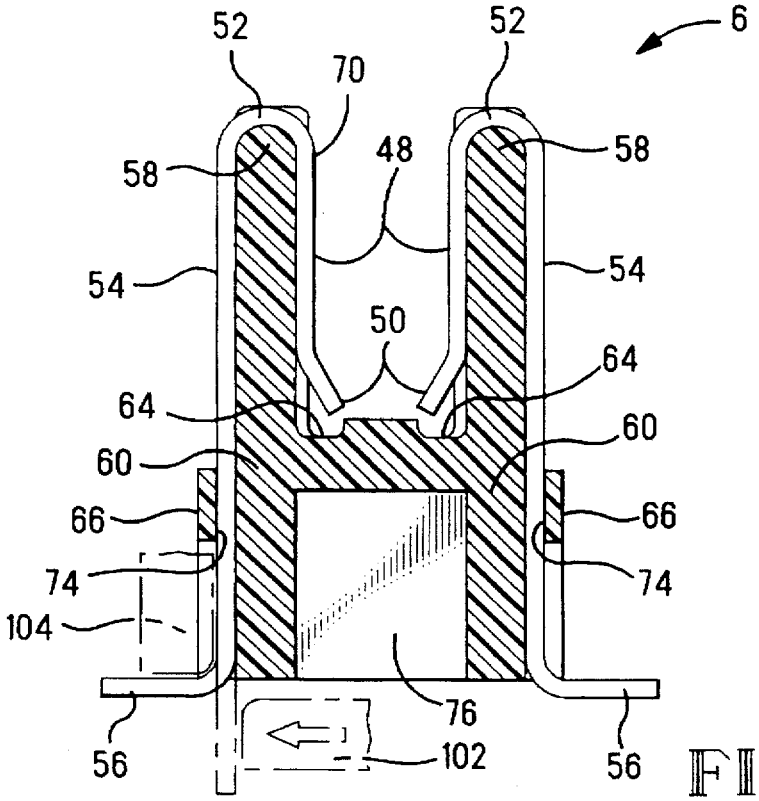
FIG. 12 is a sectional view of a plug connector employed for connecting two parallel printed circuit boards spaced apart by a first distance.

FIG. 11 shows the mating engagement of the plug connector 6 with the receptacle connector 4. FIGS. 12 and 15 show two plug connectors 6, each having a different overall height, but both mating with the same universal receptacle connector 4. Each plug contact 10 includes a mating contact section 48 adjacent one end that is configured to engage the resilient contact arm 26 of a receptacle contact 8 in the vicinity of the receptacle contact cusp 28. A central plug contact section 54 joins the mating contact section 48 with a surface mount solder tail 56 located at the opposite end of the plug contact 10. The plug surface mount solder tail 56 is formed at right angles to the central section 54 so that the solder tail can be positioned on a surface mount contact pad on a printed circuit board in conventional fashion. The mating contact section 48 is folded over at section 52 so that the mating contact section 48 is parallel to and spaced from the central plug contact section 54. The free ends 50 of the mating contact section 48 are formed outwardly to serve as stabilizing tangs. In the preferred embodiment shown herein, the plug mating contact section is secured to the housing in a fixed position and thus forms a rigid contact surface. This mating contact section 48 can also be formed as a resilient section that deflects when the plug connector 6 is mated with a corresponding receptacle connector 4. This additional deflection provides for additional tolerance due to misalignment including the position tolerance between multiple connectors located on the same printed circuit board.

The plug housing 14 is molded with two parallel walls 60 extending from the top to the bottom joined by a central web 62. The central web 62 and the portion of the walls 60 extending above it form the male mating portion of the plug housing 14. The plug housing noses 68, which are formed at the upper end of each plug housing wall 60 is spaced from the central web by a constant distance regardless of the overall height of the plug connector 6. The mating section 70 of the plug connector 6 is always the same size so that it can be mated with the universal receptacle connector 4. Two grooves 64 are formed on the top surface of the central web 62. The stabilizing tangs 50 on the plug contacts 10 fit within these stabilizing grooves 64 to stabilize the ends of the plug contacts 10. The plug housing 12 also includes contact retention ledges 66 at the bottom of the housing walls 60 in the plug mounting section 72. Windows 74 are formed in these ledges 66 and the central section 54 of the plug contacts 10 extend through corresponding windows 74. An interference fit can be established by the central sections 54 of the plug contacts in the windows 74 to prevent fluids from wicking up the central sections 54. The plug contacts 10 are stamped and formed and are inserted onto the plug housing 14 from the top as viewed in FIGS. 11–13. The solder tail 56 is bent outwardly to its final position only after it is inserted through the slot formed by retention ledge 66. A movable forming die 102 and a stationary die 104 can be used to form these solder tails 56 in the manner shown in FIG. 12. When inserted the portion of the contact 10 ultimately forming the solder tail 56 is simply a straight extension of the central contact section 54. In the assembled configuration, the plug contact 10 is supported at both ends. In other embodiments of this invention the solder tail sections 56 of the plug contacts 10 can be preformed and the contacts can be laterally inserted into T-shaped windows, open to the outside, for retention of the contacts adjacent the bottom of the plug housing. The central plug contact sections 54, being exposed when the plug connector 6 is mated to the receptacle connector 4, improve the heat transfer characteristics and can be used to dissipate heat generated by active components with which this connector assembly may be used.

Figure 13:
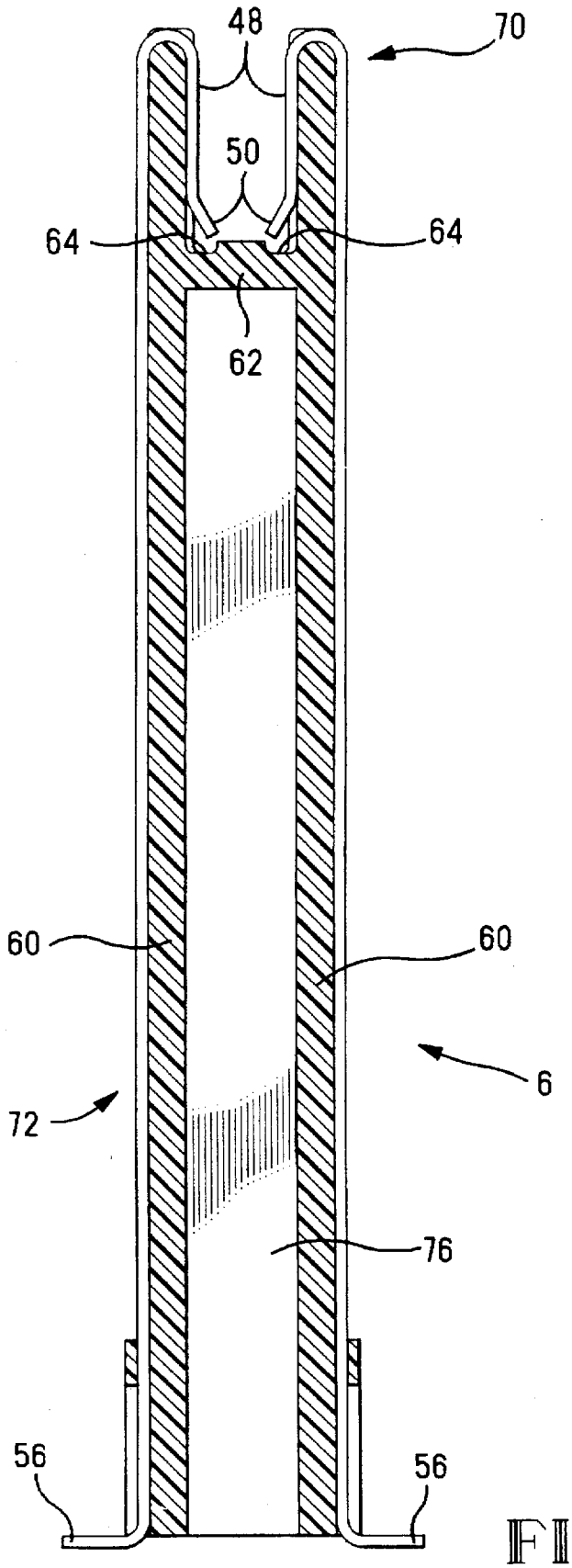
FIG. 13 is a sectional view of a plug connector employed for connecting two parallel printed circuit board spaced apart by a distance significantly greater than the first distance.

FIGS. 12 and 13 show two plug connectors of different heights. The plug connector shown in FIG. 12 is representative of a plug connector that can be used to connect two parallel printed circuit boards that are spaced apart by a distance of 6 mm. The plug connector shown in FIG. 13 can be used to connect printed circuit boards that are spaced apart by a distance of 25 mm. Each of these plug connectors 6 mates with the same universal receptacle connector 4. The only differences between the two plug connectors 6 shown in FIGS. 12 and 13 is the length of the plug contacts 10 and the height of the two plug connector walls 60. Note that it is the height of the walls 60 below the central web 62, as viewed in FIGS. 12 and 13, that changes. The height of the walls 60 above the central web 62 remains the same since this portion forms the mating interface of the plug connector 6.

The plug connector 6 is both a simpler structure and a more easily manufactured component than the receptacle connector 4. For this reason, connector assemblies for different heights, or different printed circuit board spacings, are formed, according to this invention, by using a universal receptacle connector 4 and multiple plug connectors 6, each with a different height and each matable with the one universal receptacle connector. Of course, different applications may require connectors with different numbers of positions. For example, typical applications could require connectors ranging from forty positions to two hundred positions, in intervals of twenty positions for a total of nine separate connectors. For the universal receptacle connector of this invention, each pair of housing cavities 34 and surface mount sockets 36 in the two rows, a illustrated by FIG. 4 and 5, would be the same. Therefore as forty position receptacle connector housing 12 would consist of twenty identical pairs. Therefore the receptacle housings 12 can be easily molded by combining modular mold sections of twenty positions each. Alternatively a portion of the mold could be blocked off, for example a forty position connector could be molded by using an eighty position mold and blocking off forty cavities. Either approach is compatible with multicavity molds. The repeatable nature of the housing configuration thus can reduce the overall cost of mold tooling to produce multiple sizes. Since the receptacle contacts 8 and their method of insertion is identical, the same contact insertion tooling could be used for all connector sizes, also leading to a reduction in manufacturing cost for the family of connectors.

The plug connector housing 14 is a physically simpler part than the receptacle connector housing 12 and is easier to manufacture in different heights. The plug housing 12 does not have the individual cavities or pockets in which contacts are positioned in the receptacle connector housing 12, making the mold for this housing quite simple, regardless of the number of positions. The only difference between plug housings of different heights is the length of the plug housing walls 60 between the plug housing webs 62 and the retention straps 66. Therefore the same mold sections can be used for the mating portion 70 above the web 62 and the retention ledge sections at the housing base regardless of the overall height of the plug connector housing 14 and regardless of connector height. Simple mold sections can be inserted between common upper and lower mold pieces and a large number of different plug connector housings can be molded using common mold tooling. Less tooling means less cost.

The only difference between plug contacts 10 for connectors with different heights is the overall length of the different contacts. Since the plug solder tails 56 are only formed after insertion into the housing, longer contacts simply require an extension of the straight plug contact central section. Simple inserts in progressive dies could be used, again simplifying and reducing the cost necessary for manufacturing tooling for this entire family of connectors.

Although the invention has been described with reference to an embodiment that is used to connect parallel printed circuit boards, the invention is not so limited. Printed circuit board extending at right angles could also be connected using a slightly modified version of these connectors. For example, the receptacle connector could employ receptacle contacts in which the contact would extend at right angles below the base of the connector housing. These contacts could still be surface mount contacts and two printed circuit boards extending at right angles to the base of the receptacle housing could be soldered to these contacts. The receptacle connector would then be positioned along an edge of the printed circuit board.

Figure 14:
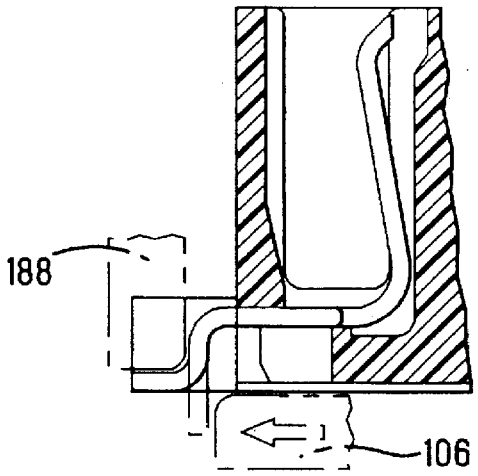
FIG. 14 is a view of an alternate embodiment showing the manner in which gull wing solder tail leads can be formed after insertion of the contacts into the housing.

Another modification of this invention could employ through hole contact tails instead of the surface mount contacts depicted in the embodiment of FIGS. 1–13. The same lateral insertion, anchoring and sealing could still be employed with this through hole receptacle and plug connector configuration. Other surface mount solder tails could also be employed with both the receptacle and the plug contacts. For example, instead of using a gull wing solder tail, the solder tails could be formed under the base of the housing in a J-lead configuration. FIG. 14 shows still another configuration in which the receptacle contact solder tail is formed after the receptacle contact 8 is fully inserted into the housing. With this approach the solder tail would initially be a straight section extending downward from an adjacent side of the housing. This tail would be exposed both above the contact along the adjacent housing side and below the housing. Two forming dies could then be used to form the contacts where a movable receptacle contact forming die 106 is positioned below the housing and a stationary receptacle forming die is positioned along the adjacent side. Forming multiple solder tails after insertion of the contacts in the housing, where they are anchored by pad 18 and channel 42, insures that all of the parallel pad sections of the gull wing solder tail will be located in the same plane, since they are simultaneously formed by the same forming tooling. If the receptacle contact solder tails are formed in this manner, the position of the solder pad surface on the contacts will be independent of any bow or warpage that may occur in the housing. Bow or warpage of the plastic housing can be a problem, especially for connector configurations having as large number of positions.

The preferred embodiment of this invention depicted herein represents just one embodiment of an electrical connector incorporating this invention. Modifications apparent to one of ordinary skill in the art still would incorporate this invention. One example would be an electrical connector in which each of the receptacle contact cavities would be enclosed on four sides eliminating the continuous slot in each row. Alternatively, the mating portion of each connector could be replaced by other configurations. For example, twin leaf or box mating contacts could be used. Of course, the receptacle housing would also be modified to incorporate other contact configurations. For example the size of the insertion opening would probably have to be changed to accept other contact configurations. Alternatively, the sealing pad and/or contact anchoring pad aspect of this invention could be employed on other connector configurations, such as card edge connector in which a printed circuit card would be inserted into the receptacle housing cavities. Of course, these alternate embodiments would not incorporate the same features and advantages of the preferred embodiment of this invention, but would nevertheless incorporate the invention defined by the following claims.

We claim:

1. An electrical connector for use with a surface mount printed circuit board comprising:

a connector housing including at least one contact cavity with an insertion opening on the bottom of the cavity; and at least one contact terminal including a mating portion and a solder tail, the mating portion being insertable through the insertion opening into the contact cavity, the contact terminal also including a sealing pad between the solder tail and the mating portion, the sealing pad being laterally offset from the solder tail, the sealing pad engaging the connector housing to seal the insertion opening so that fluids cannot enter the contact cavity from below.

2. The electrical connector of claim 1 wherein the sealing pad comprises a flat section.

3. The electrical connector of claim 1 wherein the sealing pad is laterally inserted into engagement with the connector housing to seal the insertion opening.

4. The electrical connector of claim 3 wherein the connector housing includes channels on opposite sides of the insertion opening, the sealing pad being insertable into the channels to seal the insertion opening.

5. The electrical connector of claim 4 wherein the sealing pad is wider than mating portion of the terminal.

6. The electrical connector of claim 4 wherein the sealing pad forms an interference fit in the channels.

7. The electrical connector of claim 4 wherein the housing includes an upwardly facing surface in engagement with the inner lower surface of the sealing pad and the housing includes a downwardly facing surface engagable with the outer upper surface of the sealing pad.

8. The electrical connector of claim 1 wherein the sealing pad engages the housing around the entire periphery of the insertion opening.

9. The electrical connector of claim 1 wherein the insertion opening is offset relative to the centerline of the housing cavity.

10. The electrical connector of claim 9 wherein the mating portion comprises a single resilient arm insertable through the offset insertion opening and laterally shiftable toward an inner housing wall when the sealing pad is positioned to seal the insertion opening.

11. The electrical connector of claim 1 wherein the terminal is initially partially inserted into the housing in a direction parallel to the cavity centerline and is then fully inserted into the housing by shifting the terminal laterally relative to the cavity centerline.

12. The electrical connector of claim 1 wherein the electrical connector comprises a receptacle connector matable with a plug connector.

13. The electrical connector of claim 1 wherein the solder tail comprises a surface mount solder tail.

14. The electrical connector of claim 1 wherein the surface mount solder tail comprises a gull wing solder tail.

15. The electrical connector of claim 1 wherein the connector housing includes a solder tail pocket on the bottom of the housing, the solder tail pocket being open on the side.

16. The electrical connector of claim 1 wherein the connector comprises a multiposition connector having a plurality of side by side cavities.

17. The electrical connector of claim 16 wherein the connector includes two rows of cavities.

18. The electrical connector of claim 17 wherein a slot extends through cavities in each row of cavities for receipt of a mating connector.

19. The electrical connector of claim 17 wherein the sealing pads on terminals in each row of cavities are inserted laterally inwardly toward the opposite row of terminals into engagement with the housing to close corresponding insertion openings.

20. The electrical connector of claim 1 wherein each terminal has a constant thickness with the exception of a chamfered leading edge on the portion of the sealing pad extending laterally beyond the mating portion, the chamfered leading edges comprising means to facilitate insertion of the sealing pad into channels in the housing on opposite sides of the insertion opening.

21. An electrical connector comprising:

a housing including plural contact cavities, each cavity including a contact insertion opening extending through a floor of the corresponding cavity and at least one laterally extending contact anchoring channel located adjacent the contact insertion opening and below the cavity floor, and contact terminals, one terminal being positioned in each cavity, each terminal including a mating contact portion for resilient engagement with a mating contact terminal, the mating contact portion being upwardly insertable through the contact insertion opening into the corresponding cavity and being located at the top of the terminal; each terminal also including a solder tail located at the bottom of the terminal; and each terminal also including a contact anchoring section located between the hinting contact portion and the solder tail, the contact anchoring section being laterally insertable into at least one contact anchoring channel after upward insertion of the contact mating portion through the contact insertion opening for sealing said contact insertion opening, the contact anchoring section being held in the corresponding contact anchoring channel upon deflection of the contact mating portion when mated with a mating contact terminal.

22. The electrical connector of claim 21 wherein the solder tail comprises a surface mount solder tail.

23. The electrical connector of claim 22 wherein the surface mount solder tail includes a pad extending parallel to and below the cavity floor towards one side of the housing, the pad being visible on the exterior of the housing for inspection of a solder joint between the pad and a printed circuit board.

24. The electrical connector of claim 23 wherein each solder tail is located in a housing pocket, the contact insertion openings in the housings communicating between corresponding cavities and pockets.

25. The electrical connector of claim 21 wherein parallel contact anchoring channels are located on opposite sides of each contact insertion openings.

26. The electrical connector of claim 25 wherein the contact anchoring section on each terminal comprises a flat rectangular section insertable into two corresponding contact anchoring channels.

27. The electrical connector of claim 26 wherein an interference fit is formed between each contact anchoring section and the corresponding channels.

28. The electrical connector of claim 27 wherein each contact anchoring section engages the housing around the complete periphery of the corresponding contact insertion opening to seal the housing cavity and the contact mating portion from fluids used in conjunction with soldering the connector to a printed circuit board.

29. The electrical connector of claim 21 wherein the contact mating portion is laterally movable in the corresponding cavity during lateral insertion of the contact anchoring section into corresponding contact anchoring channels.

30. The electrical connector of claim 21 wherein each contact mating portion comprises a single curved beam extending upward from the contact anchoring section.

31. The electrical connector of claim 21 wherein a section of the mating contact portion immediately adjoining the contact anchoring section extends parallel to and along the cavity floor to an upwardly bowed section, the mating contact portion including a resilient contact arm joined to the upwardly bowed section so that the mating contact portion is deflectable from the cavity floor upward.

32. The electrical connector of claim 21 wherein the contact anchoring channels extend parallel to the cavity floor.

33. The electrical connector of claim 21 wherein the solder tail comprises a gull wing surface mount solder tail.

34. The electrical connector of claim 21 wherein the mating contact portion is deflectable about the contact anchoring section held in the contact anchoring channel.

* * * * *